US008846179B2

(12) United States Patent
Saucedo

(10) Patent No.: US 8,846,179 B2
(45) Date of Patent: Sep. 30, 2014

(54) THREE-DIMENSIONAL CAMOUFLAGE SURFACE

(75) Inventor: Kent D. Saucedo, Mesa, AZ (US)

(73) Assignee: Armorworks Enterprises LLC, Chandler, AZ (US)

( * ) Notice: Subject to any disclaimer, the term of this patent is extended or adjusted under 35 U.S.C. 154(b) by 717 days.

(21) Appl. No.: 13/019,367

(22) Filed: Feb. 2, 2011

(65) Prior Publication Data

US 2012/0118133 A1 May 17, 2012

Related U.S. Application Data

(60) Provisional application No. 61/346,817, filed on May 20, 2010.

(51) Int. Cl.
*B32B 3/00* (2006.01)
*F41H 3/02* (2006.01)

(52) U.S. Cl.
CPC ..... *F41H 3/02* (2013.01); *Y10S 428/919* (2013.01)
USPC ..... 428/156; 428/919

(58) Field of Classification Search
USPC ..... 428/17, 18, 156, 919
See application file for complete search history.

(56) References Cited

U.S. PATENT DOCUMENTS

| | | | | |
|---|---|---|---|---|
| 3,622,201 | A | 11/1971 | Radig | |
| 4,021,974 | A | 5/1977 | Edwards | |
| 4,659,602 | A | 4/1987 | Birch | |
| 4,931,320 | A | 6/1990 | Leonard | |
| 5,144,877 | A * | 9/1992 | Parks | 89/36.01 |
| 5,677,017 | A * | 10/1997 | Freeman | 428/17 |
| 6,033,608 | A * | 3/2000 | Reynolds et al. | 264/54 |
| 6,499,141 | B1 | 12/2002 | Egnew | |
| 6,787,212 | B2 | 9/2004 | Strength | |
| 6,851,126 | B1 | 2/2005 | Humphreys | |
| 7,225,823 | B1 | 6/2007 | Ransom | |
| 2002/0152559 | A1 | 10/2002 | Muirhead | |
| 2005/0000616 | A1 | 1/2005 | Frantz | |
| 2005/0053732 | A1 | 3/2005 | Tilby | |
| 2006/0000499 | A1 | 1/2006 | Livacich | |
| 2010/0116442 | A1 * | 5/2010 | Pottmeyer et al. | 160/136 |
| 2010/0269876 | A1 | 10/2010 | Schlipf | |
| 2010/0330348 | A1 | 12/2010 | Lenz | |

* cited by examiner

*Primary Examiner* — Catherine A Simone
(74) *Attorney, Agent, or Firm* — James L Farmer

(57) ABSTRACT

Methods and apparatus are provided for a three-dimensional camouflage applied to the exterior of a man-made article. The camouflage comprises a surface with a visible topography defined by a predetermined arrangement of three-dimensional elements.

19 Claims, 11 Drawing Sheets

THREE-DIMENSIONAL CAMOUFLAGE SURFACE

TECHNICAL FIELD AND BACKGROUND

The present invention generally relates to camouflage, and more particularly camouflage applied to surfaces of various man-made articles such as vehicles, equipment, and structures.

Man-made articles such as clothing, vehicles, ships, aircraft, equipment, and structures are often given a camouflage color scheme intended to provide effective concealment for a particular type of environment or landscape. Traditional camouflage however suffers from a limited ability to accommodate varying conditions, such as changes in the surroundings, ambient lighting conditions, and viewing distance. Under less than ideal conditions a surface with traditional camouflage can appear "washed out", or substantially brighter or darker than the surroundings. The problem is further amplified where the object presents relatively large surfaces, such as the side of a large truck or building.

For stationary objects such as buildings and parked vehicles or equipment, the problem is often dealt with by covering the object with commercially available camouflage tarps or netting products. An example of such a product is the ULCANS camouflage netting used by the US Army. Such coverings can be less susceptible to changing conditions than a printed camouflage color pattern on a surface. Similarly, for personnel camouflage the problem is often addressed by simply attaching bits of native foliage, such as small branches and leaves, to a uniform or helmet. A more sophisticated approach favored by snipers is a type of custom made camouflage known as a Ghille suit, in which the wearer is completely covered in thousands of fabric strips.

However add-on type coverings, such as camouflage netting or a Ghille suit present a number of logistical and durability issues for long-term use, particularly if the scale of the subject is anything larger than an article of clothing. In addition, such products are generally impractical for use on moving objects such as vehicles and aircraft, and typically must be removed prior to operation and stored for future use. Camouflage coverings of this type also tend to wear out over time due to the constant handling and type of materials used, requiring replacement. Moreover, any of the above-described techniques represent purchases of aftermarket products, and thus additional expense for the initial and replacement purchases.

Accordingly a need exists for a camouflage treatment applicable to various stationary and moveable man-made articles that is not adversely affected by changes in the local environment. A further need exists for a camouflage treatment that generally does not wear out and require replacement. A further need exists for a camouflage treatment that does not require the purchase of aftermarket products at additional expense.

SUMMARY

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment." do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a camouflage applied to a man-made article. The camouflage comprises a surface with a visible topography defined by a predetermined arrangement of three-dimensional elements.

According to another exemplary embodiment, a contoured exterior surface of an object is provided that comprises an arrangement of plateaus of various sizes and shapes positioned at discrete elevation levels from a base level of the surface. The contoured exterior surface further comprises walls connecting the plateaus at one level to plateaus at other levels, wherein the walls and plateaus present a stepped topography.

According to another exemplary embodiment, a method is disclosed for producing a three-dimensional camouflage from a two-dimensional image consisting of a finite set of discrete colors arranged in various shapes and patterns. The method comprises the step of associating one color of the two-dimensional image with a base level of the camouflage. The method further comprises the step of assigning a discrete elevation level above the base level of the camouflage to at least one additional color of the two-dimensional image. The method in addition comprises providing an array of three-dimensional forms at each discrete elevation level of the camouflage that coincide with the shapes and patterns of the two-dimensional image associated with that level.

According to another exemplary embodiment, the present disclosure comprises a panel overlay for at least a portion of an exterior surface of a man-made article. The surface of the panel overlay comprises a multi-level arrangement of three-dimensional forms producing a visible topography.

Furthermore, other desirable features and characteristics of the present invention will become apparent from the subsequent detailed description and the appended claims, taken in conjunction with the accompanying drawings and the foregoing technical field and background.

BRIEF DESCRIPTION OF THE DRAWINGS

The present invention will hereinafter be described in conjunction with the following drawing Figures, wherein like numerals denote like elements, and wherein.

DETAILED DESCRIPTION

Figure 1:
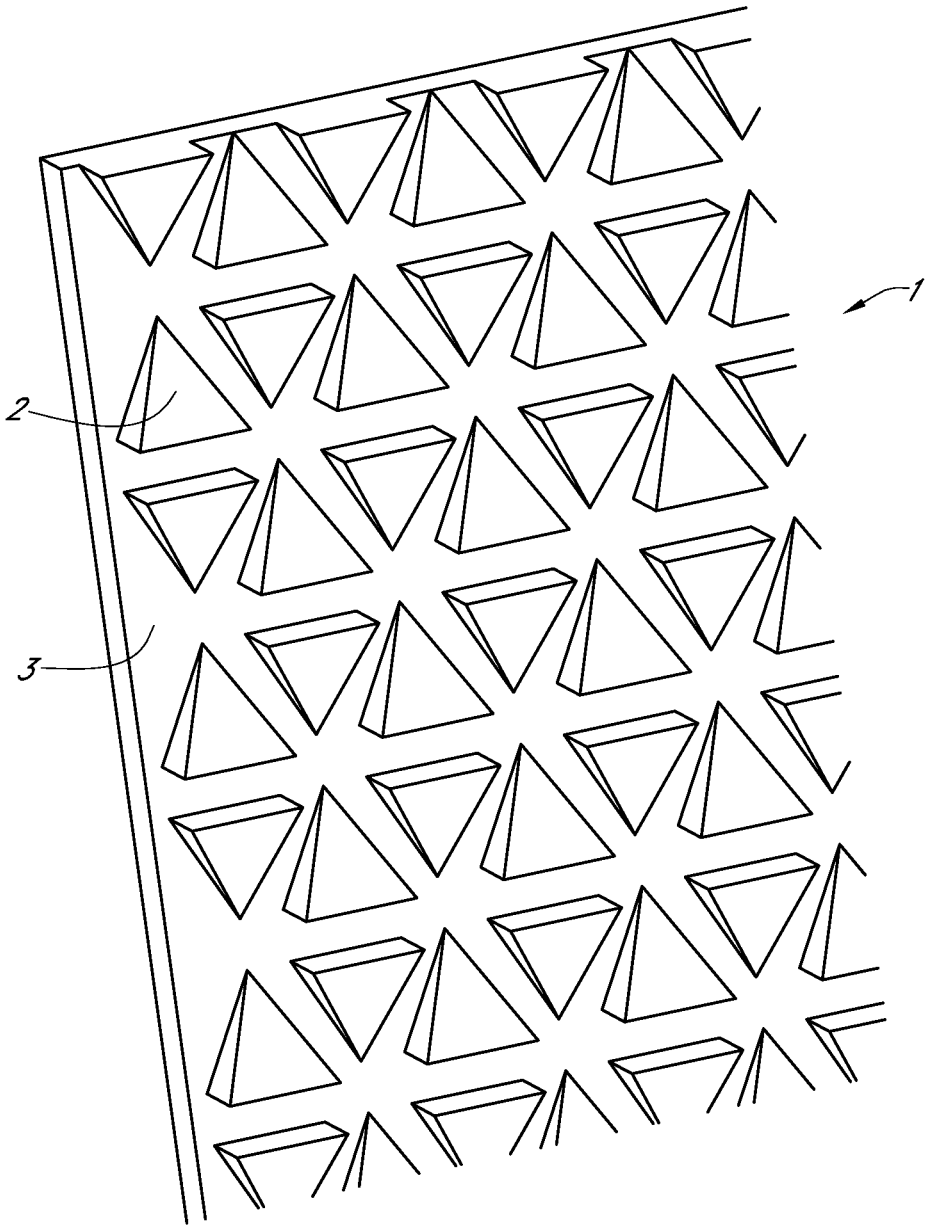
FIG. 1 depicts a camouflage in accordance with the present invention comprising an array of three-dimensional shapes on the surface of a panel.

The present invention is described more fully hereinafter with reference to the accompanying drawings and/or photographs, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

The present invention contemplates generally a form of camouflage applied to the exterior of a man-made article. In particular, an exemplary camouflage comprises a surface with a visible topography defined by a predetermined arrangement of three-dimensional elements. The camouflage may be beneficially employed to enhance concealment of such items for example as vehicles, panels, walls, buildings, equipment, containers, siding, temporary structures, tents, shelters, tarps, coverings, bunkers, silos, watercraft, ships, aircraft, helicopters, clothing, packs, pouches, vests, helmets, weapons, weapons systems, shields, blinds, and barricades.

In one preferred embodiment shown in FIG. 1 an outer surface of a panel 1 presents a highly three-dimensional topography defined by an array of raised shapes 2 projecting from a flat surface 3. The shapes 2 in FIG. 1 are distributed in a regular array and comprise essentially pairs of identical shapes in a repeating orientation and pattern. Gaps between the raised shapes 2 expose a portion of the flat surface 3 around each shape. The raised shapes 2 may have a highly angular profile as shown in FIG. 1, or alternatively any suitable contour selected to produce lines and shadows consistent with a particular background or application.

Figure 2:
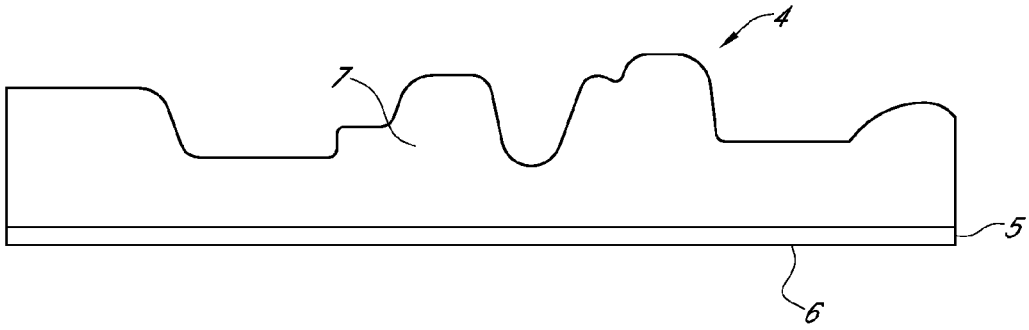
FIG. 2 is a cross sectional view of a contoured overlay with a laminated construction.

A three-dimensional contour such as that of FIG. 1 may be fabricated by any number of suitable methods, such as by machining, casting, molding, or by assembling pre-made three-dimensional shapes to a surface. For example, a prototype panel similar to the panel of FIG. 1 was made by machining the array of shapes into a plastic blank using a numerical control milling process. Other approaches may include molding or stamping the shapes directly into the outer skin of a vehicle for example, or affixing a shaped overlay to the exterior of an object. Referring to FIG. 2, a suitable overlay 4 may comprise for example a thin plastic laminate 5 with an adhesive coating 6 on one side for attaching the overlay to the object, and a three-dimensional topography 7 adhered to or formed on the other side. The three-dimensional topography could be made for example from a rigid or flexible foam material, molded to the desired shape.

Figure 3:
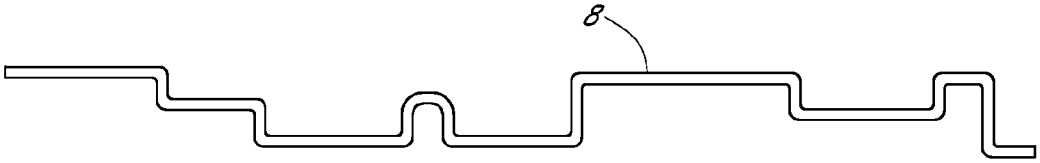
FIG. 3 is a cross section of a contoured surface comprising a molded shell construction.
Figure 4:
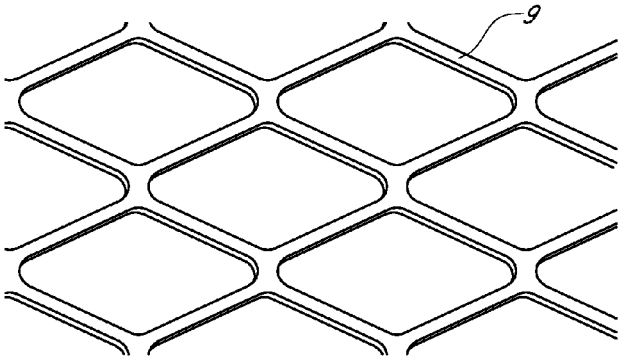
FIG. 4 illustrates a detail of a contoured surface in accordance with the invention comprising an open web structure.

Alternatively an overlay could comprise a contoured shell 8 as shown in FIG. 3 made from a material initially in sheet form that is then molded to the desired three-dimensional topography. Preferred molding techniques include for example vacuum molding or compression molding of polymer, and hydro forming of metals such as aluminum and steel. For applications requiring high strength and light weight, composite materials such as pre-preg glass or carbon fiber layups may be molded to a desired contour by matched die molding or other suitable compression process. The material comprising the overlay may be solid, or as depicted in FIG. 4, a porous open web 9 giving the appearance of a contoured netting material after molding.

Figure 5:
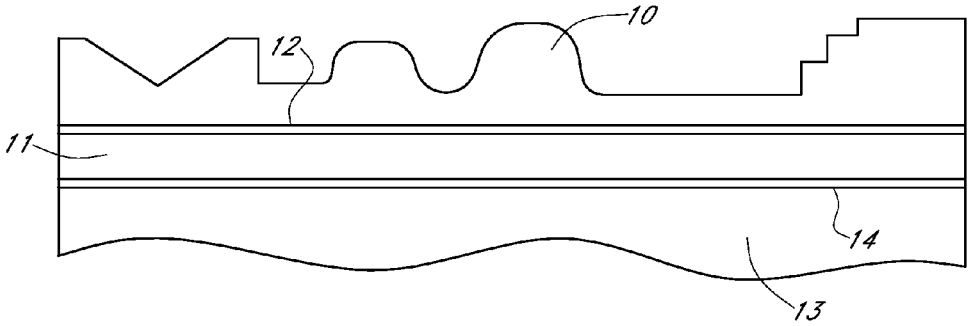
FIG. 5 is a cross section of a contoured panel backed by an insulative layer and a thermally reflective layer.

A panel overlay may be attached directly to the outside surface of the object, or through an intermediate material, such as for example a lightweight backing board. In one preferred embodiment the intermediate material is a rigid foam that increases the overall structural stiffness of the panel. In another preferred embodiment the intermediate material is an insulative material that reduces the thermal signature emitted by the underlying object. Suitable insulative materials may include for example various foams, glass fiber, micro-balloons, felts, wools, vermiculite, and any other material that inherently defines trapped air spaces. A contoured surface or panel may also include metal foils or other thermally reflective materials or films, either within the panel or within an intermediate material, to further suppress thermal emissions of an underlying object. For example, as depicted in FIG. 5 a contoured panel 10 is backed by a foam board 11 with a thermally reflective film 12 sandwiched between. The panel is attached to the exterior surface of an object 13 via adhesive layer 14.

Figure 6:
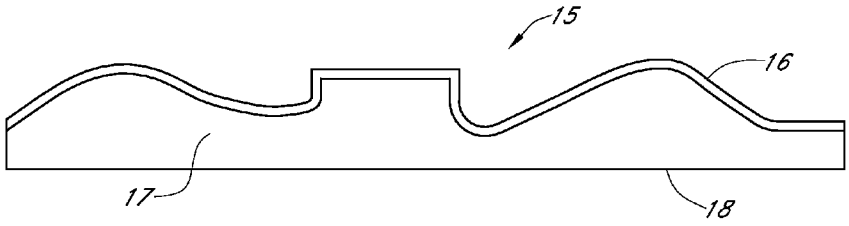
FIG. 6 is a cross section of a molded shell back-filled with an insulative material.

In the case of a panel formed by molding a sheet material, the back side of the panel may be back-filled with an insulative material that can double as a surface for attaching the panel to the vehicle. The filler may for example be a liquid foam that is injected or sprayed onto the back surface of the panel to become an integral part of the panel structure. Thermally reflective materials such as metal foils may also be incorporated into the panel during a back-fill process. An exemplary back-filled panel 15 is shown in FIG. 6, comprising a molded shell 16, backed by a foam core 17 with a flat back surface 18.

A panel in accordance with the invention may be flat as shown in FIG. 1, or curved as needed to fit a contoured surface of a vehicle or other object. Moreover a panel may comprise combinations of flat and curved elements, or any complex shape required for a particular surface. In addition, a camouflage panel may be substantially flexible or deformable through choice of materials and material thicknesses such that the panel can be conformed to various non-flat surfaces. For example, the thin plastic laminate backing of the above described overlay panel may be a flexible and stretchable plastic sheet or other suitable fabric.

The three-dimensional shapes defining the surface contour may be smooth or angular, and regular or irregularly shaped. In particular, smooth, non-angular shapes may be regular such as a hemisphere or ovoid, or irregular with various undulations, bumps, or bends. Angular shapes may include but are not limited to regular geometric shapes such as cones, prisms, cylinders, cubes, cuboids, tetrahedrons, triangular prisms, rhombic prisms, pentagonal prisms, octahedrons, dodecahedrons, and regular or irregular variations or combinations thereof. A surface contour of the present invention can be a regular and repeating array such as shown in FIG. 1, or a collection of various shapes randomly oriented and positioned. For example, shapes may be selected and positioned such that they mimic the appearance of the rocks, plants, or other features in a particular landscape or region.

Moreover, the three-dimensional contour in accordance with the invention is not limited to raised shapes protruding from a surface, or for that matter shapes that all lie in the same plane. The contour could for example be defined by recessed features such as pits or grooves within a surface, or a combination of surface regions dominated by recessed features in some areas and raised features in others. A three-dimensional contour of the present invention could further comprise various three-dimensional shapes or elements overlying one another to give additional depth and complexity.

Figure 7:
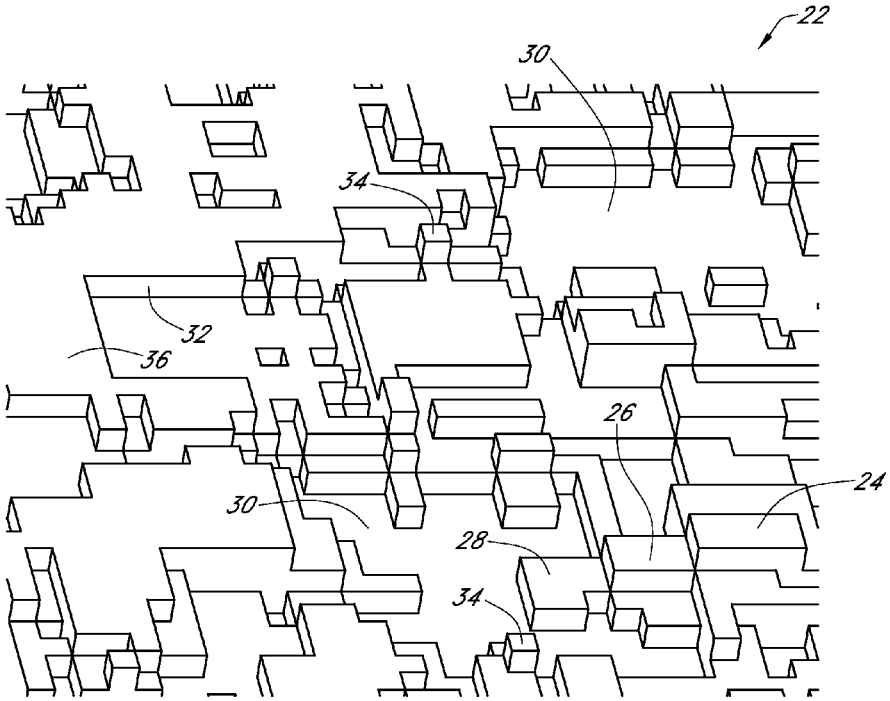
FIG. 7 depicts a camouflage of the present invention comprising a multi-level contour of variously shaped plateaus delineated by walls.
Figure 8:
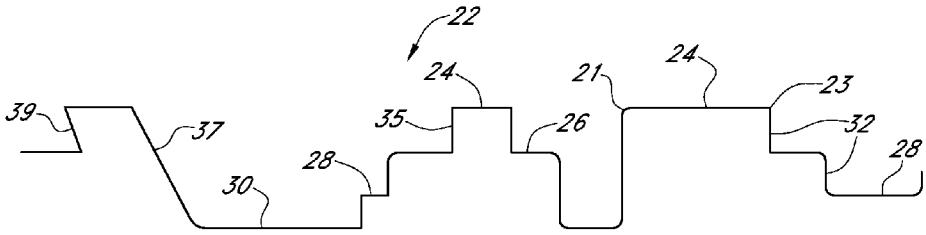
FIG. 8 represents a typical cross-section of a multi-level contour in accordance with the present invention.

In a particularly preferred embodiment illustrated by FIGS. 7 and 8, a surface comprises a multi-level contour 22. The multi level contour 22 may define an arrangement of surfaces, or plateaus 24, 26, 28 at various elevations from a base level 30. Walls 32 connect plateaus at one level to adjacent levels, to create a stepped, or overlapping appearance, with plateaus at higher levels appearing to sit atop plateaus or surfaces at lower levels. The walls 32 may be perpendicular to the plateaus, such as wall 35, or at an angle to the plateau such as walls 37 or 39 thereby producing a sloped or undercut appearance. Additionally, the corners defined by the intersection of the plateaus and walls may be rounded such as corner 21, or substantially sharp or angular such as corner 23. The plateaus 24, 26, 28 may present surfaces of any shape or size appropriate or desirable for the particular application. In the depicted embodiment the plateaus comprise groupings of one or more squares 34 to create larger, regular or irregular shapes, such as shape 36 in FIG. 7. The plateaus however need not comprise arrangements of regular geometric shapes such as squares, and indeed may comprise arbitrary shapes of any kind.

Figure 9:
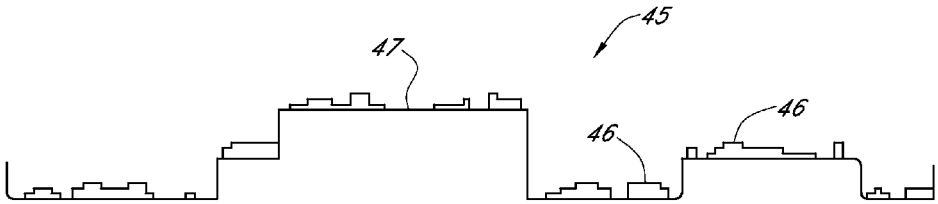
FIG. 9 illustrates an exemplary multi-scale contour defining a camouflage with two effective viewing ranges.

A variation of the multi-level contour is shown in FIG. 9. A multi-level, multi-scale contour 45 comprises a first, relatively large scale single or multi-level contour 47, and superimposed on top of that, a second, substantially smaller scale single or multi-level contour 46. Contours 46 and 47 may be simply different scales of the same design, or different designs altogether. The combination of the large and small scale contours creates a design with two effective viewing ranges. More specifically, when viewed at a relatively close range appropriate for the small scale contour 46, the edges of the large scale contour 47 are lost in the detail of the smaller scale features of contour 46. Conversely, when viewed at a larger distance at which the small scale features of contour 46 wash out and become ineffective, the larger scale features of contour 47 stand out and dominate the appearance. It should be further appreciated that although the multi-scale contour has been described in terms of two distinct scales, the same principles could be applied to create a multi-scale design with three or more effective viewing ranges by superimposing additional contours at progressively smaller scales.

Figure 10:
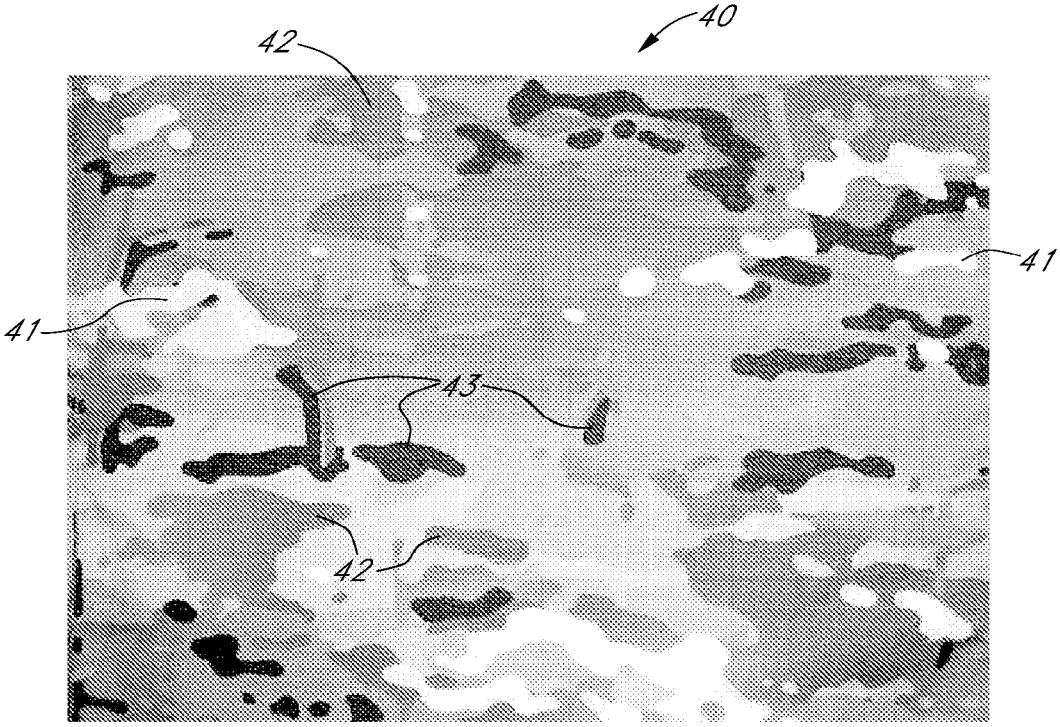
FIG. 10 is an exemplary image suitable for use as a pattern for a three-dimensional camouflage.

In another embodiment, the multi-level contour mimics the pattern and appearance of an image, such as the camouflage pattern 40 of FIG. 10. The particular exemplary pattern of FIG. 10 comprises shapes made from several discrete colors, arranged to produce a desired camouflage effect. In accordance with the present invention, the pattern of FIG. 10 may adapted to define a multi-level contour, wherein each discrete color represents a particular elevation level of the contour. For example, the white regions 41 may define a base level, the gray regions 42 an intermediate level, and the black regions 43 a top level. The elevations of each level may be equally or unequally spaced from one another, with more or fewer levels incorporated through use of additional or fewer colors in the pattern.

Further, the multi-level contour of the present invention may be utilized to give three-dimensionality to any two-dimensional pattern or image by assigning elevation values to particular colors, or color ranges. For example, it may be desirable to provide a surface contour that mimics or blends in with certain landscape features or types of foliage common to a particular region or country. Accordingly photographic images of native features may be utilized as a pattern by assigning contour elevation values to certain color or brightness ranges in the image, or to particular elements of the image such as the branches and leaves of a tree.

Figure 11:
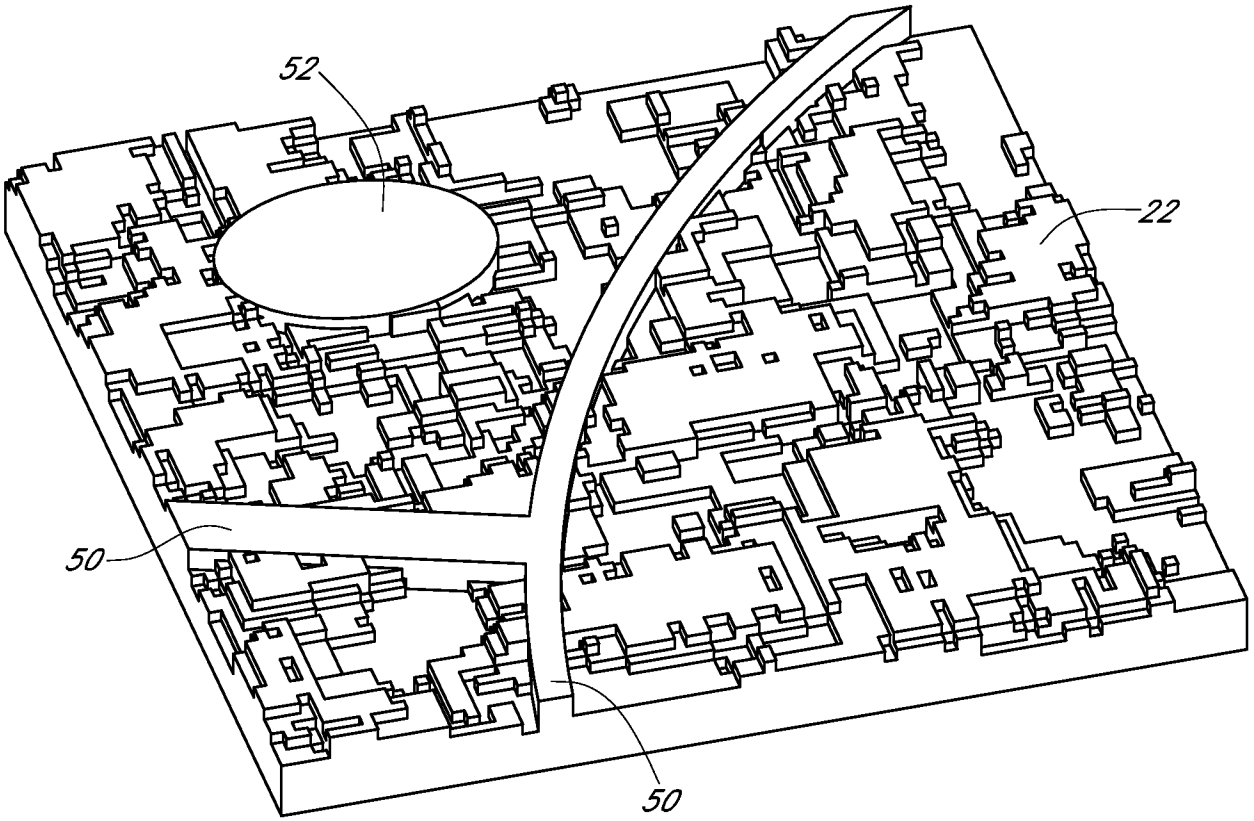
FIG. 11 is a perspective view of a three-dimensional camouflage in which contrasting shapes are interspersed with a background contour.

A contour in accordance with the present invention may further comprise various combinations of shapes and types of shapes. Referring to FIG. 11, a contoured surface may comprise for example a background array of geometric features such as the multi-level contour 22 of FIG. 7, interspersed with contrasting features such as ridges 50 and oval 52. The contrasting features may be at an elevation level of the background contour, or at a different level. Moreover, the contoured surface may comprise various combinations of contrasting shapes, including shapes that are angular, smooth, geometric, linear, irregular, arbitrary, representative of native features, and orders of magnitude different in size.

In another preferred embodiment of the invention the contoured surface is printed with a camouflage pattern. The camouflage pattern can be of any colors or known designs, including for example patterns used by the United States military, such as the Marine (MARPAT) design, the Army's Universal camouflage, and the Navy's Working Uniform. In one preferred embodiment the pattern is a multi-range camouflage design of the type disclosed in U.S. Provisional Patent Application, Ser. No. 61/345,033, assigned to and co-owned by the assignee of the present invention, the entire contents of which are hereby incorporated by reference. As provided in the incorporated reference, the multi-range camouflage design produces a first camouflage pattern when viewed from relatively close range, and a second, larger pattern when viewed from a long range distance at which the first pattern is no longer discernable.

The color pattern may be designed such that the elements of the pattern align with the shapes presented by the contoured surface. For example, in the above described embodiment where the colors in an image are used as a pattern for the levels of a multi-level contour, the alignment of the patterns in the image to the physical shapes in the surface happens automatically. In that case the color pattern of the original camouflage image may be simply transferred directly to the appropriate plateaus or shapes of the contoured surface. Conversely, any multi-level contour may serve as a color pattern by simply assigning a particular color or brightness to each elevation level of the contour.

The camouflage pattern may be applied to the contoured surface using any suitable printing or image transfer technique, such as for example an ink jet printing process. The camouflage pattern could be applied before or after the contoured surface is formed, but most preferably after. In one particularly preferred embodiment the camouflage pattern is applied to a contoured panel using a so-called "hydro transfer", "water dip", or "water transfer" technique. In summary, a water soluble film (typically polyvinyl) is printed with the desired image, and deposited directly on the surface of the water in a transfer tank. A properly conditioned surface of the object is then pushed down and through the film, with the water pressure causing the film to wrap around and adhere to the contours of the object. Employing a water dip process to apply an image to a contoured panel in accordance with the present invention thus requires a transfer tank large enough to receive at least one panel.

In another embodiment the contoured panel is printed with a camouflage pattern using a vehicle "wrap" process. The vehicle wrap process essentially comprises applying an array of vinyl decals to the entire outer surfaces of a vehicle, typically for displaying large scale graphic advertisements. The individual decals may be stretched around or into curved surfaces with the application of heat. In accordance with the present invention, a camouflage pattern is printed on one or more vinyl wrap decals of appropriate size for use on a contoured panel or object surface. The decals are adhered to the contoured surface through the use of heat and pressure causing the decals to stretch and conform to the contours. The conformance of the decal to the contoured shapes of the panel may be enhanced through the use of known techniques for applying conformal pressure, such as vacuum bagging, autoclaving, and the like.

The contoured surface may also be treated with various coatings designed to impart specific optical or physical properties to the surface. For example, various anti-reflective coatings may be applied to the contoured surface, or to a camouflage color pattern on the surface to reduce glare in bright light conditions. The surface may also be coated with a suitable radar absorbent material, or "RAM", a class of materials used in stealth technology to disguise a vehicle or structure from radar detection. Examples of RAM coatings include iron ball paint, neoprene sheets with ferrite grains, and a paint used by the U.S. Air Force made from ferrofluidic and non-magnetic substances.

The materials, design, and appearance of a three-dimensional contour are largely driven by the particular application and use. For example, a helicopter application may benefit from use of a relatively low profile topography formed using a lightweight construction such as the previously mentioned matched-die molded carbon fabric. For watercraft or ships, a much larger scale and higher profile topography may be desirable, with a coloration applied to the surface designed to match the appearance of the horizon in daylight for example. Alternatively the surface of a ship may beneficially present a partially or completely flat contour combined with a mirror finish to reflect the appearance of surrounding water. Contoured surfaces of stationary or immovable objects such as buildings may include panels made of concrete or other durable materials commonly used in the construction industry. On the other hand, a tent or a tarp incorporating a contoured surface of the present invention could be fabricated from a flexible but moldable plastic or fabric. Such a tarp may be formed of a solid or webbed material, and may further include a flexible backing such as foam rubber, or the like.

Figure 12:
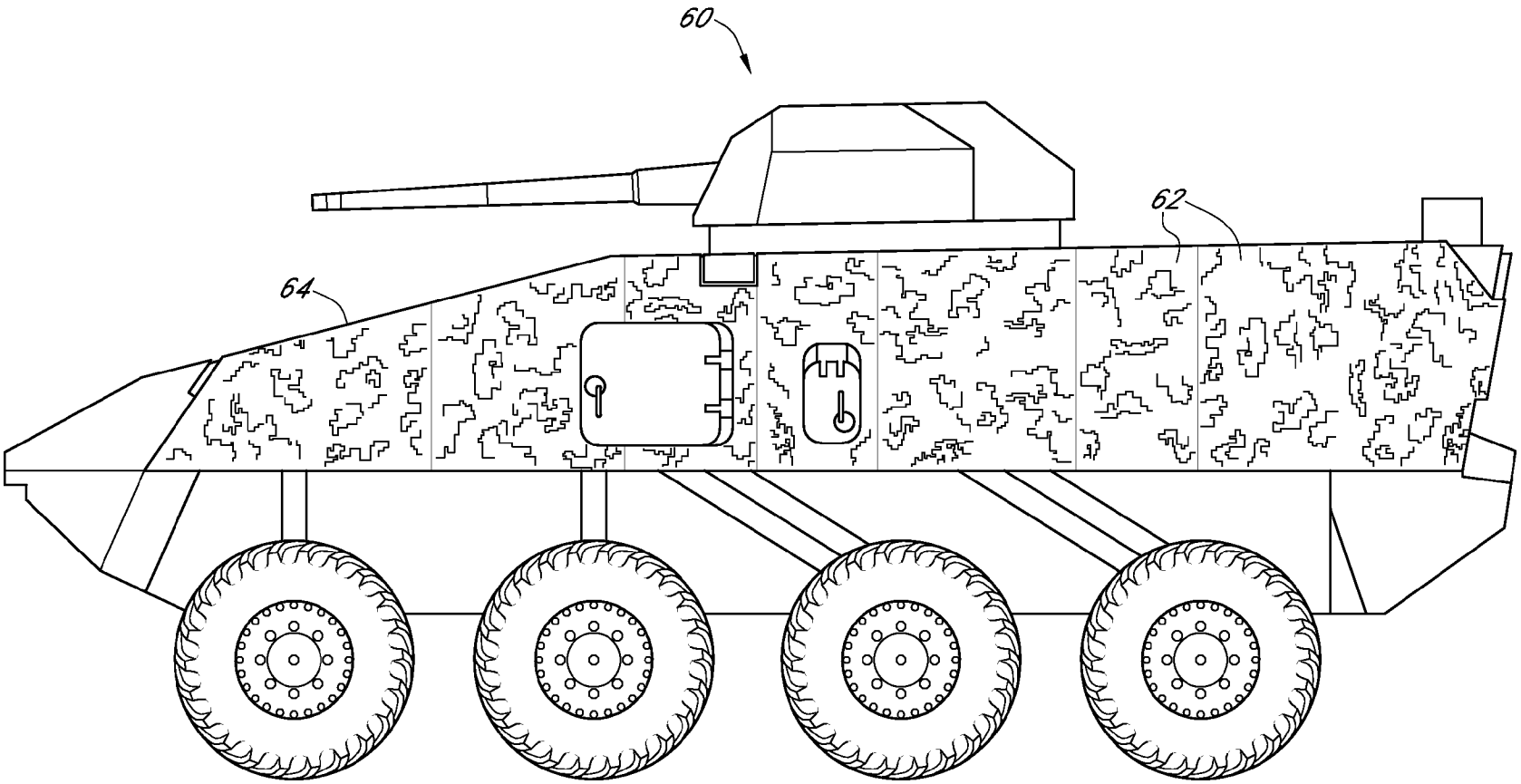
FIG. 12 is a side view of a vehicle incorporating the three-dimensional camouflage of the present invention.

FIG. 12 depicts an exemplary application of the contoured surface of the present invention to an exterior surface of a military vehicle 60. Without limitation, the contoured surface in this example comprises a panel array 64 of flat, mostly rectangular panels 62 arranged tightly together. The panels 62 may comprise for example a rigid, molded plastic shell, backed by rigid foam boards, similar to the construction depicted in FIG. 5. The particular contour is a multi-level, pixilated design with a stepped, digital appearance similar to contour 22 of FIG. 7. The contoured surface may be monochromatic, or printed with any color pattern such as a suitable camouflage. Although not specifically shown, the three dimensional camouflage may be advantageously applied to all exterior surfaces of the vehicle. For instance, the camouflage may be beneficially applied to the wheels in the form of tire side-wall cover that attaches around the wheel hub and extends radially outward over the sidewall to the tread line. The tire sidewall cover may comprise a thick molded rubber, and may further comprise materials and constructions that are resistant to rocks and ballistic projectiles. Treatment of the wheel may also include a camouflaged hubcap, which when combined with the sidewall cover acts to obscure the circular appearance of the wheel. The hubcap may further comprise insulating materials and coatings designed to block the heat signature of the wheel bearings.

Figure 13:
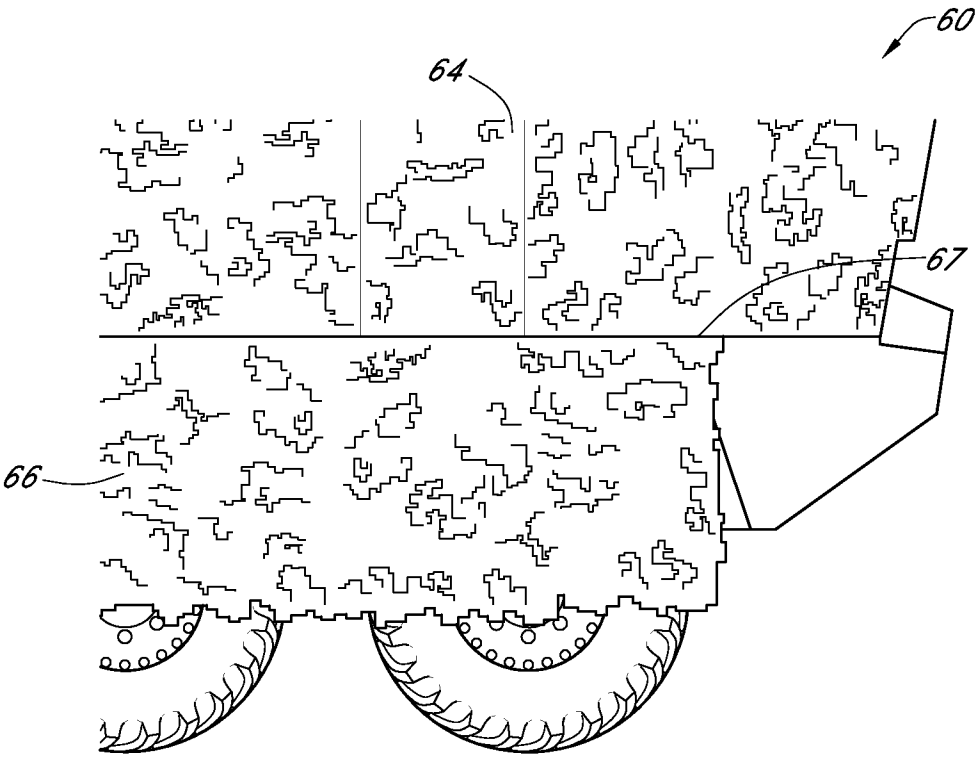
FIG. 13 is a detail view of the vehicle of FIG. 12, including a wheel skirt that incorporates the three dimensional camouflage of the present invention.

Objects such as vehicle 60 may further include additional free-standing or hanging panels that do not overlay the surface of the vehicle, or do so only partially. For example as shown in FIG. 13, the vehicle 60 may include a skirt 66 that hangs from an upper edge 67 below panel array 64, partially covering the wheels. Skirt 66 may be rigid or flexible, and constructed using any of the above described techniques and materials. Preferred constructions include for example molded flexible foam or rubber, rigid vacuum-formed plastic, and hydro formed metal. In one preferred embodiment the skirt 66 comprises a reinforced rubber material of the type commonly used in tires or certain vehicle mud flaps. The contour may be molded directly into the rubber on the outer facing surface; or alternatively the reinforced rubber may be in the form of a flat substrate combined with a flexible contoured overlay such as molded foam. As shown, the free edges of the skirt may be jagged instead of straight to further break up the profile of the vehicle to an observer. The jagged edges preferably reflect the approximate size and shape of the particular contour that defines the surface, in this case a pixilated contour. Moreover, the concept of creating a jagged edge by extending the surface contour to the edge profile is not limited to hanging panels such as skirt 66, and may be beneficially applied to the edges of any vehicle or object. For instance, the edge profile depicted along the lower edge of skirt 66 could also be effectively applied to any or all of the straight outer edges of panels 64 in FIG. 12 to break up the overall profile of the vehicle 60.

Figure 14:
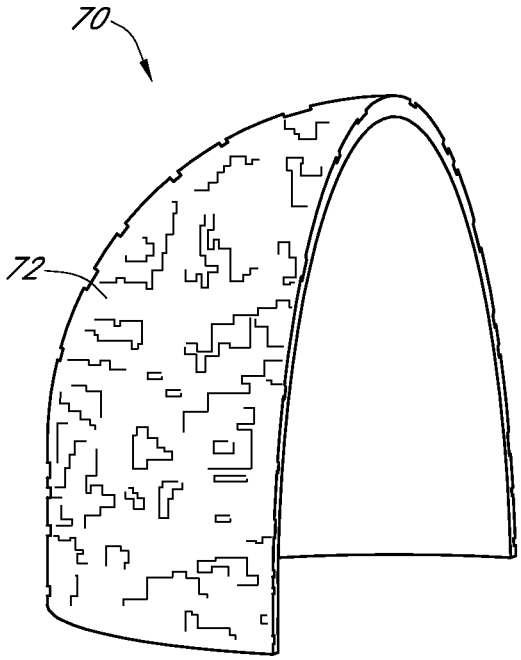
FIG. 14 is a perspective cut-away view of an antenna cover incorporating the three-dimensional camouflage of the present invention.

Free-standing contoured panels may also be used to conceal and protect equipment such as an antenna or radar dish attached to a structure or vehicle. Such panels may comprise for example a wall adjacent to an object being concealed, or an arrangement of one or more panels forming a structure that partially or completely surrounds the object. The panels may be spaced apart from the object as needed to provide access for maintenance or operation, or to provide adequate clearance for moving or rotating equipment such as a rotating antenna. The panels in such applications are preferably constructed from materials that will not interfere with electromagnetic waves, or otherwise inhibit proper operation of the equipment. In one preferred embodiment depicted in FIG. 14, an enclosure comprises a dome 70 (illustrated as a half-dome for clarity) with a contoured surface 72 for covering and protecting an antenna. The dome 70 is preferably a molded shell structure made from fiberglass, graphite composite, or other moldable material that is both weather resistant and substantially transparent to radio waves.

Figure 15:
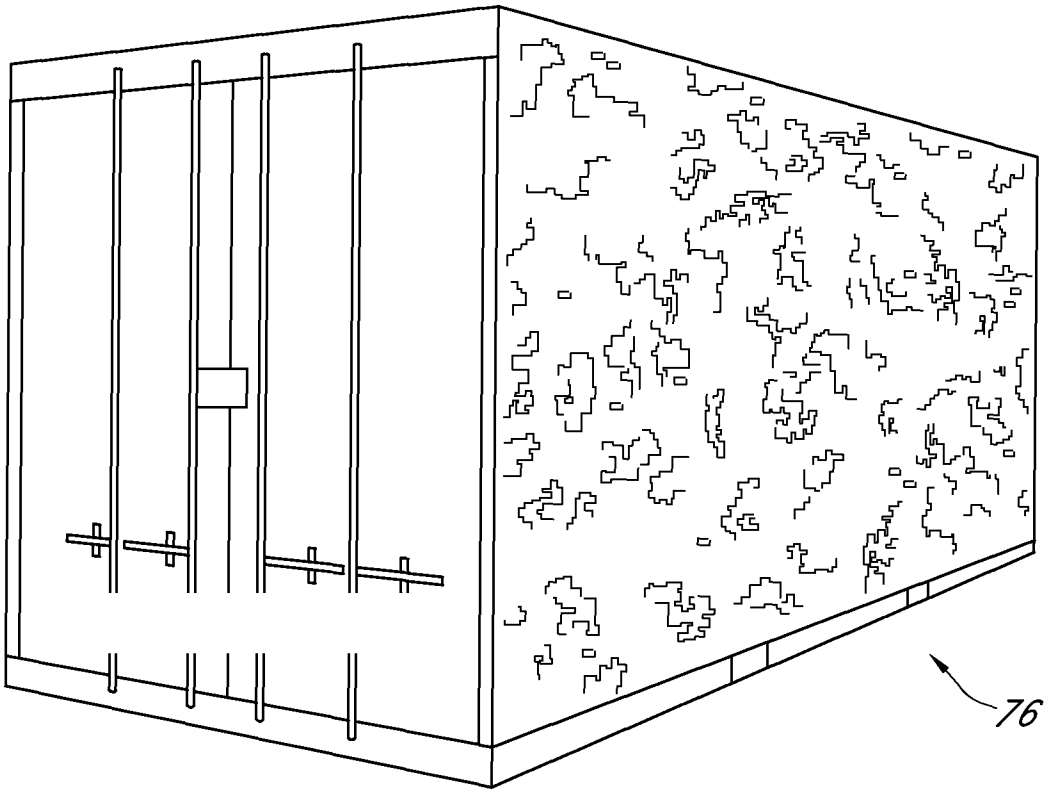
FIG. 15 is a perspective view of a shipping container incorporating the three-dimensional camouflage of the present invention.

Another exemplary application of the present invention is shown in FIG. 15, in which the exterior surfaces of shipping container 76, also commonly referred to as a conex box, present a three-dimensional topography. In one preferred embodiment the surface topography is incorporated into the manufacturing process of a new container by forming the pattern directly into the steel sides of the box through a suitable stamping or molding process. Existing containers on the other hand, may be retrofitted with contoured panels constructed using any of the previously described methods and materials.

The three dimensional camouflage surface of the present invention may also be advantageously combined with ballistic armor. For example, a contoured panel overlay of any previously described construction herein may be affixed to the armored hull of a vehicle, or to ballistic armor panels on the exterior of a vehicle. Typical lightweight ballistic armor for vehicles and aircraft is fundamentally a two-part construction consisting of a hard ceramic strike face overlaying a ballistic fabric composite backing, all encased in a light but durable material such as fiberglass. The contoured overlay could for example be attached or bonded directly to the outer durable casing on the strike face side of such an armor panel. Alternatively a three dimensional camouflage of the present invention may be integrated with a ballistic armor surface or panel, for example by molding the exterior facing side of the above described durable casing material to achieve a desired contour.

The contoured surface of the present invention may in addition be combined with armor and armor panel constructions that do not include a hard ceramic strike face. Examples of non-ceramic armor include soft armor of the type used in bullet proof vests, and rigid or semi-rigid ballistic fabric constructions utilized in various armor panels or plates. One such rigid non-ceramic fabric construction is described in U.S. Pat. No. 7,845,265 entitled "Non-Ceramic Ballistic Armor Composite", assigned to the assignee of the present invention, the entire contents of which are hereby incorporated by reference. In one exemplary integrated embodiment, a non-ceramic ballistic material itself is formed into a three dimensional contoured surface using a suitable molding process such as that described in the above noted patent. The molded ballistic material may be covered with a durable material such as fiberglass, or any of the durable materials or coatings previously described. Alternatively, semi-rigid or flexible armor materials may be integrated with the contoured surface of the present invention by molding the materials, or by combining the armor materials for example with molded foams or molded semi-rigid tarp or net-like materials.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. For example, although the present invention has been discussed primarily as it relates to military camouflage, it should be appreciated that the embodiments and characteristics disclosed herein are equally applicable to hunting or any other endeavor where concealment and stealth are important and desired. Accordingly, all such modifications are intended to be included within the scope of this invention.

What is claimed is:

1. A camouflage applied to an exterior surface of a man-made object, comprising:

a first arrangement of plateaus of various sizes and shapes positioned at discrete elevation levels from a base level of the surface, the plateaus connected to one another by walls, wherein the walls and plateaus present a stepped topography; and a second arrangement of plateaus of various sizes and shapes superimposed on the first arrangement of plateaus, wherein the second arrangement of plateaus is substantially smaller in scale than the first arrangement of plateaus.

2. The camouflage of claim 1, wherein the plateaus comprise side-by-side arrangements of one or more of a particular geometric shape.

3. The camouflage of claim 2, wherein the particular geometric shape is a square.

4. The camouflage of claim 1, wherein a particular color is associated with each discrete level of the surface.

5. The camouflage of claim 1, wherein the corners defined by the intersections of the plateaus and walls are rounded.

6. The camouflage of claim 1, wherein at least one wall is not perpendicular to the plateaus.

7. The camouflage of claim 1, wherein the camouflage comprises a panel overlaying an exterior surface of the man-made object.

8. The camouflage of claim 1, wherein the appearance of the camouflage is dominated by the first arrangement of plateaus at a first viewing distance, and by the second arrangement of plateaus at a second viewing distance that is substantially closer to the object than the first viewing distance.

9. An overlay for covering at least a portion of an exterior surface of a man-made article, the surface of the overlay comprising a first multi-level arrangement of three-dimensional forms producing a visible topography; and a second multi-level arrangement of three-dimensional forms superimposed on the first multi-level arrangement of three-dimensional forms, wherein the second arrangement of forms is substantially smaller in scale than the first arrangement of forms.

10. The overlay of claim 9, wherein the first multi-level arrangement of three-dimensional forms comprises plateaus of various shapes and sizes at a first discrete elevation level of the topography, and walls connecting the plateaus at the first elevation level to a base level, and wherein the second multi-level arrangement of three-dimensional forms comprises plateaus of various shapes and sizes at a second discrete elevation level of the topography, and walls connecting the plateaus at the second elevation level to plateaus at the first elevation level.

11. The overlay of claim 9, wherein the overlay comprises a sheet of material molded to the shape of the multi-level arrangement of three-dimensional forms.

12. The overlay of claim 11, further comprising a back fill of a rigid, insulating foam material.

13. The overlay of claim 9, wherein the man-made article is a vehicle.

14. The overlay of claim 13, further comprising a camouflage color pattern applied to the surface.

15. The overlay of claim 10, further comprising contrasting shapes interspersed with the plateaus.

16. The overlay of claim 9, wherein the overlay is easily deformable to fit the shape of the man-made article.

17. The overlay of claim 9, further comprising a layer of thermally reflective material.

18. The overlay of claim 9, wherein the exterior surface of the man-made article comprises a ballistic armor material.

19. The overlay of claim 9, wherein the overlay comprises a ballistic armor material.

* * * * *